United States Patent [19]

Browning

[11] Patent Number: 4,540,121

[45] **Date of Patent: * Sep. 10, 1985**

[54] HIGHLY CONCENTRATED SUPERSONIC MATERIAL FLAME SPRAY METHOD AND APPARATUS

[76] Inventor: James A. Browning, P.O. Box 863, Hanover, N.H. 03755

[ * ] Notice: The portion of the term of this patent subsequent to Nov. 22, 2000 has been disclaimed.

[21] Appl. No.: 530,171

[22] Filed: Sep. 7, 1983

Related U.S. Application Data

[63] Continuation-in-part of Ser. No. 287,652, Jul. 28, 1981, Pat. No. 4,416,421, which is a continuation-in-part of Ser. No. 196,723, Oct. 9, 1980, abandoned.

[51] Int. Cl.[3] ..... B05B 7/20

[52] U.S. Cl. ..... 239/13; 239/79; 239/81; 219/121 PL; 219/121 PY; 51/321

[58] Field of Search ..... 239/1, 8, 13, 79, 81, 239/85; 219/121 PL, 121 PM, 121 PP, 121 PQ, 121 PY; 51/321, 410

[56] References Cited

U.S. PATENT DOCUMENTS 4,370,538 1/1983 Browning ..... 219/121 PY 4,384,434 5/1983 Browning ..... 51/410

4,416,421 11/1983 Browning ..... 239/79

*Primary Examiner*—Andres Kashnikow

*Assistant Examiner*—James R. Moon, Jr.

*Attorney, Agent, or Firm*—Sughrue, Mion, Zinn, Macpeak and Seas

[57] ABSTRACT

Particulate material, which may be heat softened or liquified, or which may remain solid, is fed outside of an electrical heating zone for electric arc heating under pressure a continuous flow of heated gas, or outside of a combustion chamber producing high pressure, high temperature products of combustion, axially into the converging flow of the heated gas or products of combustion while entering a converging portion of a flow expansion nozzle having a nozzle bore of a length that is at least five times the diameter of the nozzle bore. This restricts the diameter of the column of particles passing through the nozzle bore to prevent build up of particle material on the nozzle bore, if molten or heat softened, while insuring sufficient dwell time within the bore to effect particle heat softening or melting, or if the particles are solid, to prevent abrasion of the nozzle bore wall by the particles while accelerating the particles to supersonic velocity.

11 Claims, 3 Drawing Figures

1
2
3
4
5
5a
6
7
8
9
11
12
12a
13
13a
13b
13c
13d
14
14a
14b
15
15a
16
16a
16b
17
18
19
20
21
22
23
24
30
32
34
36
40
40a
40b
41
41a
42
43
44
45
46
47
48
49
50
51
52
53
54
55
56
57
58
59
60
61
62
R
S
P
112
114
115
132
145
150
151
161

HIGHLY CONCENTRATED SUPERSONIC MATERIAL FLAME SPRAY METHOD AND APPARATUS

This Application is a continuation-in-part application of application Ser. No. 287,652, now U.S. Pat. No. 4,416,421, filed July 28, 1981, entitled "HIGHLY CONCENTRATED SUPERSONIC LIQUIFIED MATERIAL FLAME SPRAY METHOD AND APPARATUS"; which, in turn, is a continuation-in-part application of application Ser. No. 196,723 filed Oct. 9, 1980, similarly entitled and now abandoned.

FIELD OF THE INVENTION

This invention relates to supersonic particle spraying systems and to a method and apparatus for increasing the temperature and velocity of the spray stream to effect flame spray application of particles at extremely high supersonic velocities.

This invention also relates to improved abrasive-blast apparatus powered by a highly heated flame gas using a confined flow stream of abrasive particles offering long life to the nozzle through which the particles are sprayed.

BACKGROUND OF THE INVENTION

Attempts have been made to provide flame spray apparatus which include an internal burner operating to produce an ultra-high velocity flame jet. One such ultra-high velocity flame jet apparatus is set forth in my earlier U.S. Pat. No. 2,990,653 entitled "METHOD AND APPARATUS FOR IMPACTING A STREAM OF HIGH VELOCITY AGAINST THE SURFACE TO BE TREATED" issued July 4, 1961. Such apparatus comprises an air cooled double or triple wall cylindrical internal burner whose interior cavity forms a cylindrical combustion chamber. Downstream of the point of initial combustion, the chamber is closed off by a reduced diameter flame jet nozzle.

In a further attempt to provide such ultra-high velocity flame spraying apparatus for metal, refractory material or the like, introduced to the high velocity flame spray stream in powder form or in solid small diameter rod form, an arrangement was devised utilizing a hot gaseous primary jet stream of relatively low momentum which fuses and projects a stream of molten particles into a second gaseous jet stream of lower temperature, but possessing a very high momentum. Such type of apparatus and method is set forth in U.S. Pat. No. 4,370,538 filed May 23, 1980, entitled "METHOD AND APPARATUS FOR ULTRA-HIGH VELOCITY DUAL STREAM METAL FLAME SPRAYING". The method and apparatus of that patent employs the first stream in the form of an oxy-fuel flame or an electric arc-producing plasma, while the second stream comprises a flame-jet produced by an air/fuel flame reacting at high pressure in an internal burner device. In combining the two streams, preferably the molten particles are carried by the first stream at relatively low velocity but relatively high temperature, while the supersonic jet stream which impinges the entrained molten particles against the surface to be coated at ultra-high velocity is discharged from an internal burner combustion chamber wherein combustion is effected at relatively high pressure. The second stream is directed through an annular nozzle surrounding the primary stream. Further, the primary and secondary streams are projected through a nozzle structure to the point of impact against the substrate to be coated as liquid particles travelling at supersonic speed, under the acceleration provided by the secondary jet of heated gas. In some cases, as in spraying of high temperature ceramics, the oxy-fuel flame may not be hot enough to provide adequate melting of the particles.

In conventional cold air powered abrasive blast (sand blast) equipment, it is usual to use an elongated nozzle made of extremely hard material such as tungsten carbide through which the abrasive particles are directed at supersonic velocity. The compressed air stream with entrained abrasive particles passes through such nozzle and is accelerated to peak velocities of about 100 meters per second. There is no need in such conventional cold air powered technology to confine the particle stream flowing through the nozzle bore. For such conventional apparatus, the particles strike the walls of the nozzle with little abrasion effect due to the choice of nozzle material.

When the accelerating compressed air stream is replaced by the hot products of combustion, of a like flow of compressed air, the available energy to accelerate the abrasive particles is increased about eightfold. Peak particle velocities over 300 meters per second are obtained. Such an impacting stream against the surface to be cleaned is several-fold more effective than that for its cold air flow counterpart, and additionally great economies of operation result.

In an effort to design reliable hot gas abrasive blast systems, many attempts have been made to use materials such as water-cooled tungsten carbide for the inner nozzle surface. However, it has been found impractical to prevent nozzle wear by such excessively hard metal. The carbide is heated to the point where it is eroded away by oxidation and additionally the material may crack badly.

SUMMARY OF THE INVENTION

The present invention relates in part, to a flame spray method comprising the steps of electric arc heating, under pressure, a continuous flow of electrically conductive gas confined to flow within an essentially closed passage, discharging said heated gas from the passage through a flow expansion nozzle as an extremely hot gas stream and feeding material to the stream for high temperature heat softening or liquefaction and spraying onto a surface positioned in the path of the stream at the discharge end of the nozzle. The improvement lies in the step of feeding of the material as by introduction of the material in solid form outside of the electrical heating zone and axially into a converging flow of electrically heated gas after exit from the electrical heating zone while entering a converging portion of a flow expansion nozzle whose nozzle bore length is at least five times the diameter of the nozzle bore throat to restrict the diameter of the column of particles passing through the nozzle bore, to prevent build-up of particle material on the nozzle bore wall while insuring sufficient dwell time within the bore to effect particle heat softening or melting.

The invention is further directed, in part, to a highly concentrated heat softening or liquefied material flame spraying apparatus which comprises a spray gun body having an essentially closed electric arc heating zone within the body, means for continuously flowing a gas under pressure through the heating zone and with the body including electrical heating zone discharge passage means at one end thereof. The body further comprises an elongated nozzle downstream of the electrical heating zone discharge passage means and the nozzle includes the converging inlet bore portion leading to a throat and having an extended length outlet bore portion and wherein the bore has a length that is at least five times the diameter of the nozzle bore throat. The electrical heating zone discharge passage means comprises means for conveying a converging flow of the discharging electrically heated hot products after exit from the electrical heating zone into the entrance of the nozzle inlet bore portion, and means for introducing material in solid form outside of the electrical heating zone axially into the hot gases entering the entrance of the nozzle inlet bore for subsequent heat softening or melting and acceleration. The point of introduction of the solid material is at the entrance to or within the converging inlet portion of the nozzle bore to prevent build-up of particle material of the nozzle bore wall while insuring sufficient particle dwell time within the gas stream to effect particle heat softening or melting prior to particle impact on a substrate downstream of the discharge end of the nozzle bore.

The invention further concerns a highly concentrated, hot gas, supersonic abrasive blast apparatus which involves an abrasive blast gun body with a high pressure, essentially closed combustion chamber within the body, and means for continuously flowing an oxy-fuel mixture under high pressure to the combustion chamber for ignition within the chamber. The body includes combustion chamber products of combustion discharge passage means at one end thereof, and the body further comprises an elongated nozzle downstream of the combustion chamber discharge passage means with a nozzle including a converging inlet portion leading to a throat and having an extended length outlet portion leading from the throat, with the bore having a length that is at least five times the diameter of the nozzle bore throat. Combustion chamber discharge passage means comprise means for conveying a converging flow of the discharged hot products of combustion, after exit from the combustion chamber into the entrance of the nozzle inlet bore portion and the apparatus further comprises means for introducing solid, particulate abrasive material outside of the combustion chamber, axially into the hot combustion gases for acceleration thereby, with the point of introduction of the particulate abrasive material being at the entrance to or within the converging inlet portion of the bore of said nozzle to restrict the diameter of the column of particles passing through the nozzle bore and prevent contact of the particles with the nozzle bore wall and erosion of the nozzle bore, while accelerating the particles to supersonic velocity prior to particle impact on a workpiece downstream from the discharge end of the nozzle bore.

Preferably, the means for introducing solid, particulate, abrasive material axially into the hot combustion gases comprises means for supplying a stream of combustible fluid bearing hard particulate material to the apparatus upstream of the combustion chamber discharge passage means within the body, including means defining a confined straight flow path leading to the small diameter material feed passage within the body and centered within the circumferentially spaced inclined small diameter passages. Further, means are provided within the confined straight flow passage for separating a portion of the combustible fluid, radially outward of the confined straight flow path, from the hard particulate material and for introducing the particle free combustible fluid into the essentially closed combustion chamber within the body for stabilization of combustion therein.

DESCRIPTION OF PREFERRED EMBODIMENTS

Figures 1, 3:
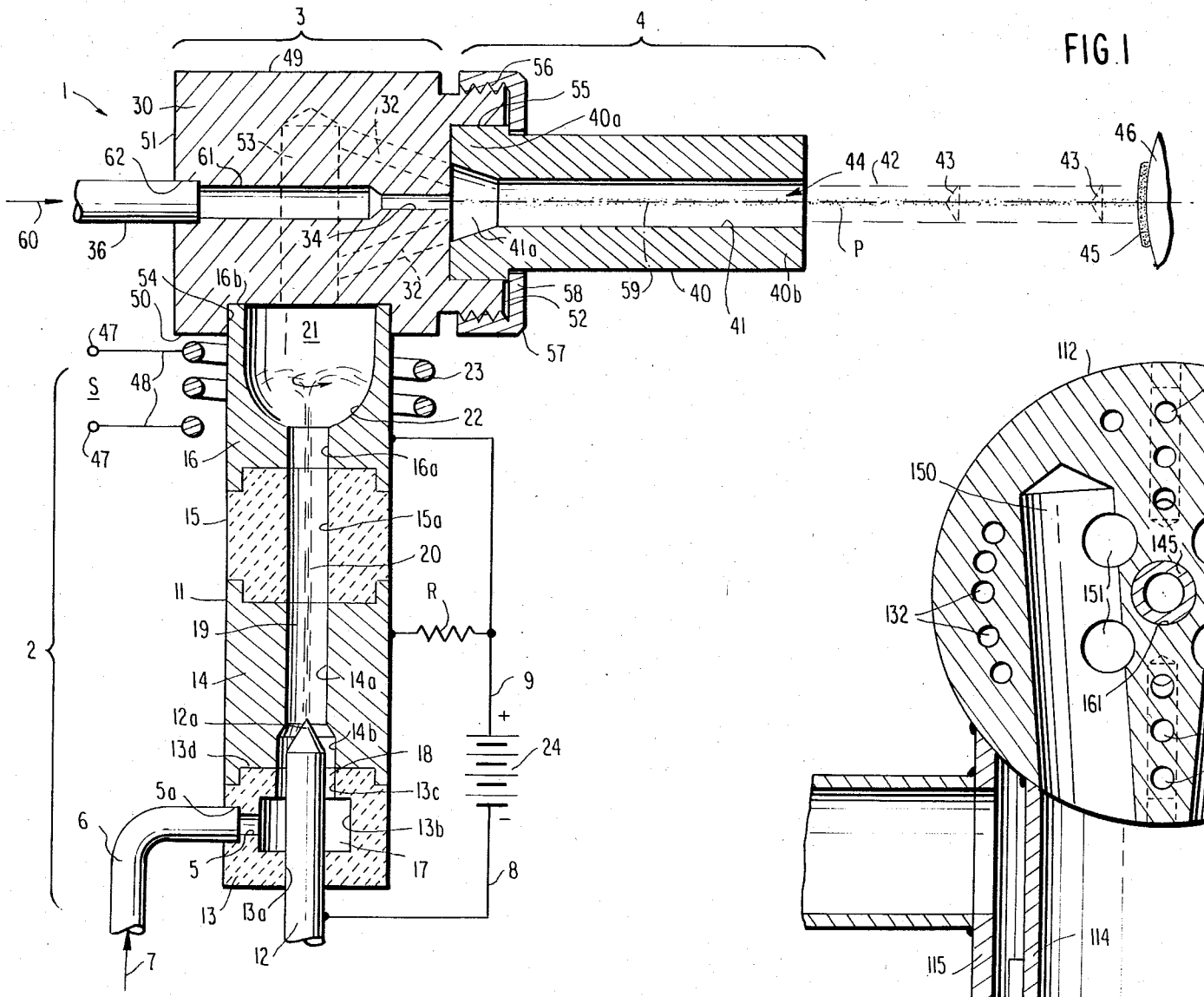
FIG. 1 is a longitudinal, sectional view of the present invention of a highly concentrated supersonic flame spray apparatus forming a first embodiment.
FIG. 3 is a sectional view of a portion of the apparatus of FIG. 2, taken about line 3—3.

Referring to FIG. 1, there is illustrated in longitudinal sectional form, and somewhat schematically, the main elements of the improved flame spraying apparatus forming one embodiment of the present invention.

The means for providing the electrical heating to the flow gas for replacement of the oxy-fuel flame in the illustrated embodiment utilizes the principles of the commonly called "plasma torch". The apparatus indicated generally at 1 takes the form of a flame spray torch comprised of these main sections: a plamsa heat source section 2, the torch body section 3, and a spray nozzle section 4. The plasma heater section 2 is formed principally of an elongated cylindrical plasma heater 11. The heater 11 is fabricated from several cylindrical different elements including an electrically non-conducting cathode electrode support piece 13. Piece 13 supports coaxially a cathode electrode 12 formed usually of thoriated-tungsten. A hollow cylindrical conductive piece 14 is mounted to support piece 13 and is provided with an axial passage 19 defined by bore **14*a* and counterbore 14*b*. A further non-electrically conductive spacer 15 is interposed at the end of conductive piece 14 and between that conductive piece and hollow cylindrical anode-electrode piece 16. Elements 13, 14, 15 and 16 include bores and/or counterbores to form a passage 19 therethrough. In that respect, electrically non-conductive support piece 13 is provided with a bore at 13*a*, an enlarged counterbore 13*b* and terminates in a somewhat smaller diamter counterbore 13*c* adjacent end 13*d* abutting the conductive cylindrical piece 14. The bore 13*a* is sized so as to sealably mount electrode 12 which is of similar diameter and which projects into and through the bore 13*a* and through counterbore portion 13*b* and 13*c* of support piece 13. The electrode 12 has its end tapered and tip 12*a* is positioned within counterbore 14*b* of electrically conductive piece 14**.

Further, electrically non-conductive spacer 15 is provided with a bore **15*a* sized to bore 14*a* of piece 14 and forms the portion of passage 19 within spacer 15. Likewise, the electrically conductive anode-electrode piece 16 is provided with a bore at 16*a* opening to bore 15*a* and spacer 15 as a further continuation of passage 19**.

A radial hole 5 extends through the side of cylindrical support piece 13 and hole 5 is counterbored from the exterior as at **5*a* so as to receive the end of a flow gas supply tube 6 which carries a continuous flow of gas under pressure as evidenced schematically by arrow 7**.

The conductive piece 14 is electrically conductive, being of a metal such as copper and is electrically connected to the positive side of a power source indicated schematically at 24 through a resistor R. The opposite side of the power source 24 is connected via line 8 to the cathode-electrode 12. Line 9 on the positive side of the source 24 connects to the anode-electrode piece 16 through a circuit path parallelling the resistor R connection of that source to the electrically conductive cylindrical piece 14. Spacer 15 electrically isolates these two pieces, 16 and 14 from each other. An electric arc indicated schematically at 20 is initially established by effecting a high frequency or capacitor discharge from the tip 12*a* of electrode 12 to piece 14. The initial arc column has a low current flow due to the resistance R in the pilot circuit. The pilot arc does, however, produce sufficient ionization of the gas flow from gas flow source 7 to establish the main arc column 20 axially along passage 19.

The anode-electrode piece 16 is hollowed out from end 16*b* to form a large concave cavity or expanded passage volume 21 into which the arc column 20 is carried by the gas flow 7 exiting from passage 19. The gas flow 7 enters annular manifold 17 formed by counterbore 13*b* after discharging from gas supply tube 6, the gas exiting from the annular manifold 17 through an annular passage 18 about the periphery of electrode 12. The gas 7 becomes highly heated by arc action in its flow through passage 19 and prior to reaching the expanded passage volume 21. The heated gas velocity reduces in the expanded volume 21 and exerts less force on extending and centralizing the arc column 20. The somewhat semi-spherical cavity wall surface 22 is shaped to form an extended face of equal potential characteristic. The arc passes easily to any point on the surface 22 to cover a large anode area, thus reducing overheating of the metal anode-electrode piece 16. This piece 16 may likewise be formed of copper.

A magnet coil 23 which concentrically surrounds the anode-electrode piece 16 and which is supplied by an electrical source indicated schematically at S, via terminals 47, provides a high rotative velocity to the arc spot intersecting surface 22. The coil 23 may be conventionally powered by a DC power source, which in fact can be the arc current itself. The power source is applied to terminals 47 which conduct current by way of leads 48 to the coil 23.

Important to the present invention is the utilization of the torch body 30 and nozzle 40 constituting the principal elements of sections 3 and 4 of the apparatus 1. Body 30 which may be of rectangular metal block form includes a top wall 49, a bottom wall 50, an end wall 51 to the left, and terminates in an end wall 52 at the right. The bottom wall 50 is provided with a circular bore 54 within which fits the end of cylindrical anode-electrode piece 16. Further extending from bore 54, which penetrates only a short distance into block 30, are parallel manifold holes 53 both of which open to the expanded volume 21 and define a manifold feeding respectively paired convergent holes 32 which pairs converge towards each other and in the direction of end wall 52 and towards the other convergent holes 32 opening to the second of the manifold holes 53. End wall 52 of torch body 30 is provided with a circular bore as at 55 within which is positioned inlet end 40*a* of cylindrical nozzle element 40. Nozzle element 40 has a reduced diameter portion 40*b* over its major length forming a collar at inlet end 40*a*. Further, the torch body 30 terminates near end wall 52 in an annular portion which is threaded as at 56 to which is threaded a coupling ring 57, the coupling ring 57 being flanged at 58 so as to ride on the outer periphery 40*b* of the nozzle element 40. Locking ring 56 locks the inlet end 40*a* of nozzle element 40 to the torch body 30 with the collar within circular bore 55. The nozzle element 40 includes an extended length bore or passage 41 which extends the major length of the nozzle element 40 and which bore 41 includes an enlarged converging portion 41*a* at the nozzle inlet end 40*a* of that element. The converging inlet portion 41*a* of the nozzle bore 41 conforms to the inclination and convergence of the four passages 32 which are aligned therewith such that the high temperature, high velocity gas flow from the plasma heater section 2 enters the nozzle bore as four separate flows converging towards the axis 59 of nozzle bore 41. The temperature of the gas entering the nozzle bore 41 may be controlled to provide adequate heating of particles P passing into it axially from a samll diameter injector hole 34 opening to the nozzle bore at the converging inlet end portion 41*a* of that nozzle bore. The powder particles P enter injector hole 34 from a particle supply tube 36 which is fitted to the second of two counterbores 61 and 62, which counterbores function as extensions to the initial bore defining injector hole 34.

A flow of carrier gas under pressure indicated schematically by arrow 60 with the particles P entrained therein functions to introduce the particles P into the converging high temperature high velocity flow of the gases discharging from the plasma heater section 2.

Where supersonic gas flows are desired, the gas pressure at the entrance to nozzle passage 44 defined by nozzle bore 41 and its convergent inlet portion 41*a* must be above critical pressure. The exhausting jet 42 from the outlet end 40*b* of nozzle element 40, under supersonic conditions, exhibits shock diamonds 43. The plasma-heated gas melts or softens the powder particles P and injects then at high velocity to form coating 45 on workpiece or substrate 46 positioned at a point in an area intersecting the exhausting jet 42.

Compared to conventional plasma torches, the dwell time of the accelerating powder particles P in the hot gas is many times greater. To be brought to the same elevated temperature requires a gas flow of much reduced temperature, even below that of a true plasma (a gas at least partially in its ionate state). This allows more uniform particle heating with less advanced chemical reaction since the particle dwell time is relatively low.

For high-pressure gas operation, required to produce supersonic exit jet 42 velocities, the plasma-generator portion of the spray torch 1 must be designed to allow reliable operation for over long periods of time. This need is best met using, for a given power level, low amperage currents at high voltage drop across the electrodes 12 and 16. The voltage at a given gas pressure is a function of the gas type and length of arc columns 30. The arc column is best extended by providing an electrically non-conducting element 15 or spacer between electrodes 12 and 16. To provide a narrow arc column 20 to pass centrally through passage 19, the gas flow 7 may be made to whirl, forming a core of somewhat reduced pressure along the axis of passage 19. The arc current favors this region of low voltage gradient and stands well away from the containing walls with the result that overheating of these walls is effectively reduced. Of course, the polarity of coil 23 should be that which will enforce the whirling of the arc anode spot.

As may be appreciated, the present invention very effectively provides for the electric heating of the flow gas by using the principles of the commonly called "plasma torch" and permits utilizing the plasma torch section as a source of flow gas of suitable temperature. The apparatus is very effective in the spraying of high temperature ceramics where the oxy-fuel flame of the referred to applications may not be hot enough to provide adequate melting of the particles. It should be understood, however, that all the principles of the extended length heating path of the apparatus and method of those applications relate equally well to the case of electrical heating and, in particular, the utilization of the plasma torch technique. In particular, when compared to conventional plasma spray torches, the increased path length of the particles within the heated gas allows for the use of lower heated gas temperatures although higher in temperature (where required) than for the oxy-fuel case. In addition to providing a higher temperature gas flow, the plasma system allows the use of inert gas flows where oxygen containing gases can be tolerated due to chemical reaction with the particles to be transported by the high temperature gas at supersonic velocity for discharge onto or against a substrate.

It should be noted that in the method of the present invention by discharging the hot gases into a converging portion of the flow expansion nozzle, preferably the hot gases are discharged through multiple converging passages which are inclined relative to the axis of the nozzle bore, which passages open up at one end to the inlet portion of the nozzle bore upstream of the nozzle bore throat. At their other ends they open to the essentially closed passage from which the heated gases discharge after being electrically arc heated. The inclined passages converge towards the axis of the bore with the axis of the bore and the axes of the converging passages being coplanar to minimize the whirling velocity component of the gas flow through the flow expansion nozzle bore. Further, the gases are caused to pass through the nozzle bore over a nozzle bore length of such an extent that the temperature of the hot gas flow is reduced to below the disassociation temperature of the gas flow. Under certain conditions, the gases are forced to flow through the expansion nozzle as a high velocity gas stream with a nozzle length being such that the particles discharged are still in their plastic or molten state at discharge therefrom.

Conventionally, water or other cooling medium may be circulated through various passages within the components of the plasma spray apparatus for cooling of the components, such means including circulation loops commonly employed in this field which have been purposely deleted for simplifying the disclosure. Also the powder P as in the referred to application enters the high velocity gas by being entrained axially into the center of that gas and into the converging inlet bore portion 41*a* of the nozzle element 40. As such, the powder is not permitted to touch the walls of bore 41, either at the inlet portion 41*a* the throat 41*c* or over the balance of the bore. This concentration or "focussing effect" is advantageous whether the particles actually melt or are simply driven at very high velocity out of the outlet end 40*b* of the nozzle element for impact against substrate 46. A wire or rod may replace the particles P and in which case would be sized to and fed directly into the injector hole 34 coaxial with axis 59 of the nozzle element. Additionally, although supersonic mode has been discussed, there are some cases where subsonic regimes are desired and the projection may be subsonic with all the advantages of supersonic operation.

Figure 2:
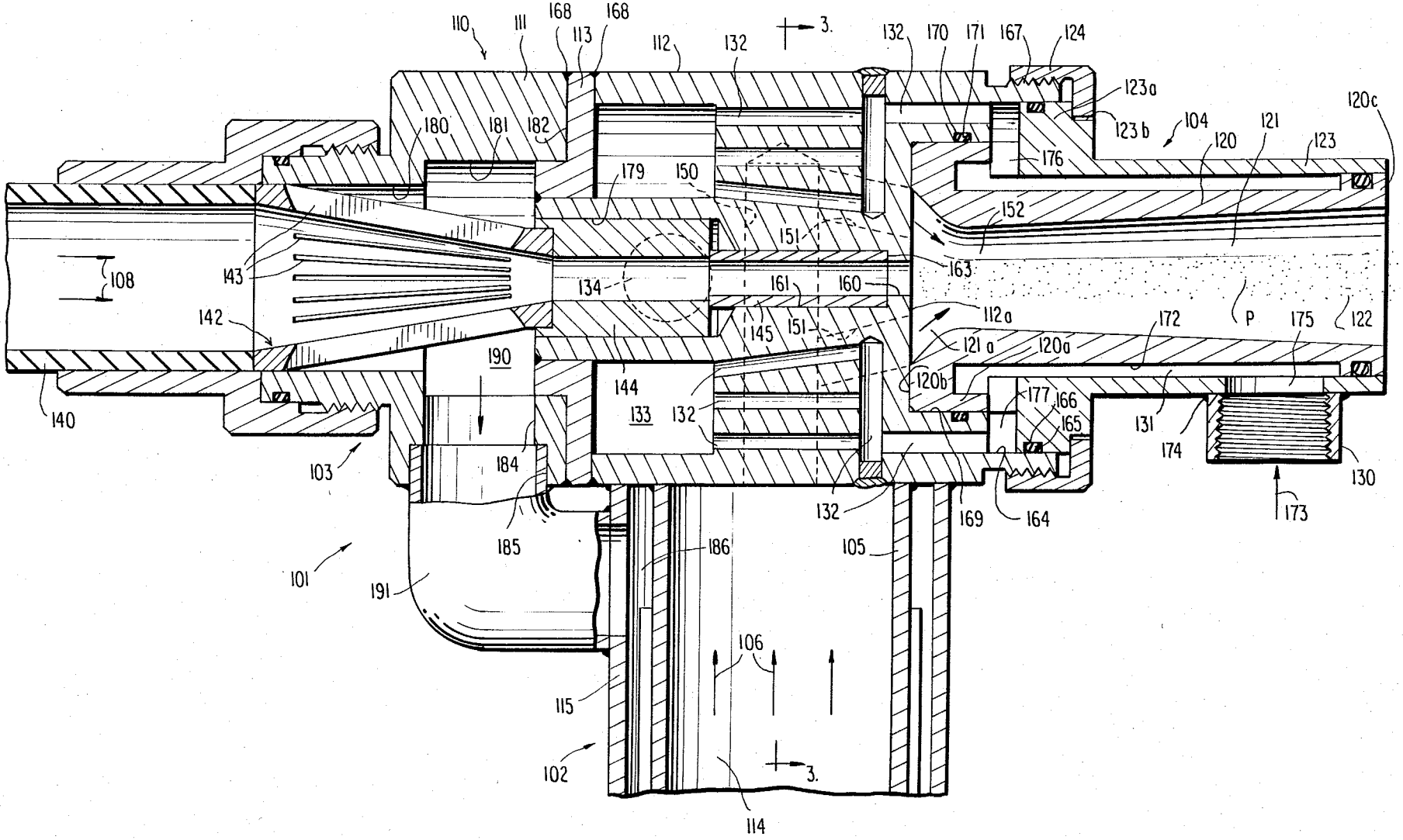
FIG. 2 is a longitudinal sectional view of an abrasive-blast apparatus powered by highly heated flame gases forming a second embodiment of the present invention.

FIGS. 2 and 3 illustrate a commercially acceptable heated gas abrasive-blast apparatus and in which there is minimial nozzle line erosion. Such apparatus eliminates the necessity to use hard material to define the nozzle bore which has not proven practical in the past and in which the control of the heated gas flow acting as the accelerating stream causes the abrasive particles to pass essentially through the nozzle bore well separated from the nozzle wall surface. The apparatus utilizes the principles employed in relation to the acceleration and jetting of a heatsoftenable material as described in conjunction with the first embodiment, and this embodiment of the invention utilizes common elements with respect thereto.

Referring to FIGS. 2 and 3, a second embodiment of the present invention constituting a heated gas abrasive blast apparatus which is indicated generally at 101 is comprised of three main sections: an air/fuel internal burner section indicated generally at 102; a sand separator section indicated generally at 103; and a spray nozzle section indicated generally at 104.

The apparatus 101 is of Tee configuration in vertial elevation and may constitute a hand held unit of a type known in the industry as a "Tee Gun". Further, the apparatus 101 is an improvement of the high velocity flame jet internal burner for blast cleaning and abrasive cutting which is the subject of my earlier issued U.S. Pat. No. 4,384,434 issuing May 24, 1983. In the embodiment of FIG. 2 of that patent and in the apparatus 101, both apparatus incorporate an air/fuel internal burner which is aligned at right angles to the path of the abrasive flow. The content of U.S. Pat. No. 4,384,434 is included by specific reference into this application, and the construction and operation of the internal burner section 102 of the embodiment of FIGS. 2 and 3 are essentially identical to that of the issued patent. In that respect, the products of combustion issue from combustion chamber 114, defined by the internal burner cylinder wall 105, as indicated by arrows 106 and pass into the interior of a main body piece 110 constituted by a metal block of cast or machined construction via two relatively large diameter manifold holes 150. Holes 150 are drilled partially through cylindrical block 112, from the bottom of block 112 upwardly, as may be best seen in FIG. 3. Opening to the manifold holes 150 are four inclined holes 151 which converge towards the axis of the cylindrical block 112 and which open outwardly of block 112, through end face 112*a* of that member. The make up, positioning and connections between holes 150 and 151 in this embodiment are similar to those of corresponding components 53 and 32 in the embodiment of FIG. 1. By injecting the products of combustion through the four inclined holes 151, the products of combustion enter into the converging inlet bore portion 121*a* of nozzle bore indicated generally at 121 for an elongated nozzle indicated generally at 120. Thus, the confined flow of the combustion gases through the inclined holes 151 cause the products of combustion, as they enter the nozzle inlet bore portion 121*a*, to merge into one another and to concentrate axially within the elongated nozzle bore 121.

In this embodiment, an abrasive material such as sand or other fine particulate material suspended in compressed air indicated schematically by arrows 108, passes from a hopper (not shown) through a flexible hose 140 to a particle separator, indicated generally at 142, and forming a principal element of the sand separator section 103. The particle separator 142 constitutes a tubular metallic cone bearing a plurality of slots 143. Slots 143 run lengthwise and are separated circumferentially. They could be annular and separated lengthwise. Downstream of the particle separator 142 there is provided a steel cylinder 144 which is coaxial with the particle separator. Block 112 is provided with a bore 160 and a counterbore 161. The counterbore 161 receives a tungsten carbide injector in the form of a cylindrical tube 145 whose inner diameter is on the order of bore 160 with the downstream end of the tungsten carbide injector 145 abutting against a shoulder 163 defined by bore 160 and counterbore 161 within block 112. Bore 160 opens directly to the elongated nozzle 120 and is coaxial thereto. Thus the tungsten carbide injector 145 insures delivery of the abrasive particles to throat 152 of the nozzle 120 via converging inlet bore portion 121*a*.

As may be appreciated, only a small portion of the total air utilized in transporting the abrasive particles P (i.e. sand) is employed in delivery of the abrasive particles P into the nozzle section 104 to be accelerated by the combustion product gases 106 created by the burning of the remaining compressed air flow in this portion of the apparatus 101.

Nozzle 120 is held in place by a cylindrical, flanged holder 123. The holder 123 includes a radially enlarged flange portion 123*a* at the end proximate to the block 112. Further, block 112 is provided with a circular axial recess 164 sized to flange 123*a*. An O-ring seal as at 165 may be mounted within an annular slot 166 within the periphery of flange 123*a* functioning as a seal between the flanged holder 123 and block 112. Flange 123*a* is recessed, as at 123*b*, the recess bearing a threaded nut 124 which threads to the outer periphery of cylindrical block 112, at 167. Thus, the holder 123 is threadably connected to the main body cylindrical block 112, via nut 124. The body 110 is comprised of a number of subcomponents of cylindrical form, of a relatively hard metal as at 111 and 113 in addition to the cylindrical block 112 previously described. These subcomponents 111, 112 and 113 may be welded together at their interfaces as indicated by welds 168.

In order to cool the exterior of the nozzle section 104 and the portion of block 112 where the hot products of combustion pass therethrough, prior to entrance to the nozzle 120, a continuous flow of cooling water passes through a cooling circuit formed within those elements. In that respect, body 112 is counterbored at 169 and the nozzle 120 includes a radially enlarged flange 120*a* fitted to counterbore 169 such that end face 120*b* of the nozzle lies flush with end face 112 of body 112. An annular groove 170 is provided within body 112 at counterbore 169 which receives an O-ring seal 171 for sealing the connection between nozzle 120 and body 112 in this area. Additionally, the nozzle 120 is provided with a cylindrical recess 172 which extends generally the full length thereof and which creates an annular cavity 131 between the outer periphery of nozzle 120 and holder 123. A flow of coolant such as water under pressure indicated by arrow 173 is directed to cavity 131 through a cylindrical inlet 130 which inlet is welded at 174 to the periphery of holder 104. A hole 175 opens through the holder at this point and is aligned with inlet 130 so that the coolant flows, as per arrow 173, into cavity 131 and runs the length of the nozzle 120 to cool the same. A series of radial slots 176 within the flange portion 123*a* of holder 123 further permits the flow of coolant water radially to an annular recess 177, at the axially inboard upstream end of holder 123. A series of drilled or otherwise formed cooling flow passages 132 formed within body 112 permit the cooling water under pressure to flow from the inlet 130 to a relatively large annular manifold 133 within cylindrical block 112 and which surrounds the steel cylinder 44 mounted to the block 112 by axial insertion within counterbore 179 of that member. The cooling water leaves manifold 133 through an exit passage of cylindrical form as at 134 which projects to the exterior of block 112 to one lateral side thereof. Appropriate hoses, pump, and a supply of coolant water (all not shown) create a closed circulation loop leading to inlet 130 and leading from outlet 134 of the Tee Gun type apparatus 101.

Appropriately, and in conjunction with the teachings of my prior U.S. Pat. No. 4,384,434, the cylindrical metal element component 111 of composite body 110 is provided with a bore at 180, and counterbore 181. Counterbore 181 is sized to an axial recess 182 within a disclike component 113 of body 110 with the counterbore 181 defining an annular flow collection chamber 190 about the conical particle separator 142. Additionally, the conical particle separator 142 is spaced from bore 180 such that there is a large annular chamber 190, defined partially by bore 180 and counterbore 181, which chamber 160 extends the complete length of the particle separator 142 to the extent of the slots 143. Additionally, a circular hole 184 is formed within component 111 which is counterbored at 185 and which receives one end of elbow 191. The other end of elbow 191 is welded to outer cylinder 115 of the internal burner section 102. The outer cylinder 115 is spaced from the cylinder 105 to define an annular chamber 186 through which the air flows to cool the exterior of the tee burner internal burner 102, while preheating the air which forms the primary source of combustion air for internal burner section 102. The major flow of air from the air and sand stream 108 entering the unit, passes through the narrow slots 143 of the abrasive separator 142 into the manifold chamber 190 and thence to the internal burner 114, via elbow 161.

The construction and operation of the air/fuel internal burner 114 is as described in detail in U.S. Pat. No. 4,384,434. Usually, fuel oil is used with the separated air to burn within combustion chamber 114. Natural gas or propane may be substituted for the liquid fuel oil.

In this embodiment of the invention, the abrasive particles P which enter the converging inlet portion 121*a* of the nozzle bore 121 pass centrally through the nozzle bore 121 as a slightly diverging conical flow 122 from throat 152 outwardly towards the exit end 120*c* of the nozzle. It is has been determined that the apparatus 101 operating with 600 SCM of comressed air and having a nozzle throat diameter of 1⅛ inches and a nozzle length of nine inches may operate hour after hour with essentially no impact of the solid abrasion particles P against the surface wall of nozzle bore 121. Thus, a nozzle made of mild steel can function for an extended period of time without need of replacement since there is virtually no abrasion by the abrasive particles P due to the focussing effect of the combustion gases 106 at the converging inlet end 121*a* of the nozzle bore. By utilizing the principles of the present invention in the embodiment of FIGS. 2 and 3, there is effected a large price reduction in the cost of the unit over the cost of tungsten carbide elements including the nozzle previously used in an attempt to provide wearability to the nozzle and other components. Additionally, even tungsten carbide has not proved to be suitable for highly heated gases as the accelerating medium employed in the present invention. Additionally, the principles of the present invention, although described for an apparatus in which heated gas provides the acceleration needed, eliminates swirling and functions to concentrate the abrasive particles after separation from the major portion of the air stream in particle separator 142, they are equally suitable for an apparatus in which there is a cold air flow as the accelerating stream and wherein the reduction in nozzle cost may be achieved due to the concentration of the particle stream as it passes the complete length of the nozzle 120.

It should be appreciated that, while the operation of the abrasive separator in the apparatus 101 of FIGS. 2 and 3 is as that described in issued U.S. Pat. No. 4,384,434, when this element is employed within the Tee burner utilizing body 112 for controlled introduction of the products of combustion into the inlet end of a converging nozzle of extended length through multiple inclined holes 151, it is important that the particles P injected into the nozzle to meet the combustion gases 106 possess adequate momentum to carry them axially a sufficient distance into the hot gases, i.e. in the area of throat 152 of the nozzle to effect a tight conical pattern as at 122 through the nozzle bore 121. By proper sizing of the abrasive separator 142 and the passage defined by injector 145, the correct ratio of the two air flows may be maintained. In this embodiment as in the embodiment of FIG. 1, it is important, that the nozzle bore 121 be of a length that is at least five times the diameter of the nozzle bore throat 152 to properly restrict the diameter of the column of particles passing through the nozzle bore, either to prevent build up of molten or soft particle material on the nozzle bore wall while insuring sufficient dwell time within the bore to effect particle heat softening or melting, as for the first embodiment, or to prevent abrasion of the nozzle bore wall by the particles P in the embodiment of FIGS. 2 and 3. To achieve that end, the introduction of the particles P is effected outside of the zone of combustion for the embodiment of FIGS. 2 and 3 and outside the electrical heating zone for the embodiment of FIG. 1, which material must feed axially into the electrically heated gas for the apparatus of FIG. 1 or the converging flow of the combustion gases for the apparatus of FIGS. 2 and 3. Further, it is required that the feeding of the material axially into the converging flow of the gas is effected while such gas enters a converging portion of the flow expansion nozzle. Thus, the parameters of operation resulting in the improvements described herein are common to both the embodiments in this application and in my prior applications Ser. No. 287,652 and Ser. No. 196,723 and are critical in obtaining those improved results.

While the invention has been particularly shown and described with reference to preferred embodiments thereof, it will be understood by those skilled in the art that the various changes in form and details may be made therein without departing from the spirit and scope of the invention.

What is claimed is:

1. In a flame spray method comprising the steps of:

electrically arc heating, under pressure, a continuous flow of a gas confined to flow within an essentially closed passage, discharging said heated gas from said passage through a flow expansion nozzle as an extremely hot gas stream, and feeding material to said stream for high-temperature heat softening or liquifaction and spraying onto a surface positioned in the path of the stream at the discharge end of the nozzle, the improvement wherein:

the step of feeding said material comprises introducing said material in solid form outside of said electrical heating zone and axially into a converging flow of said electrically heated gas after exit from the electrical heating zone, while entering a converging portion of the flow expansion nozzle having a nozzle bore of a length that is at least five times the diameter of the nozzle bore throat to restrict the diameter of the column of particles passing through said nozzle bore and to prevent build-up of particle material on the nozzle bore wall while insuring sufficient dwell time within the bore to effect particle heat softening or melting.

2. The flame spray method as claimed in claim 1, wherein the step of discharging the heated gas from said passage through a flow expansion nozzle as an extremely hot gas stream includes the step of minimizing the whirling velocity component of the gas flow through the flow expansion nozzle bore.

3. The flame spray method as claimed in claim 1, wherein the step of discharging the heated gas from said passage through a flow expansion nozzle as an extremely hot gas stream comprises causing said gas to pass through said nozzle bore over a nozzle bore length of such an extent that the temperature of the hot gas flow is reduced to below the disassociation temperature of the gas flow.

4. The flame spray method as claimed in claim 1, wherein the step of discharging the heated gas from said passage through a flow expansion nozzle as an extremely hot gas stream comprises passing said hot gas stream through a nozzle whose length is such that the particles discharging are still in their molten state.

5. A highly concentrated heat softened or liquified material flame spray apparatus comprising:

a spray gun body, passage means defining an essentially closed electric arc heating zone within said body, means for continuously flowing a gas under pressure through said heating zone passage, said body including electrical heating zone discharge passage means at one end thereof, said body further comprising an elongated nozzle downstream of said electrical heating zone discharge passage means, said nozzle including a converging inlet bore portion leading to a throat and having an extended length outlet bore portion, and wherein said bore has a length that is at least five times the diameter of said nozzle bore throat, said electrical heating zone discharge passage means comprising means for conveying a converging flow of the discharging electrically heated gas after exit from the electrical heating zone into the entrance of said nozzle inlet bore portion, and means for introducing material in solid form outside of the electrical heating zone axially into the hot gas for subsequent heat softening or melting and acceleration, with the point of introduction of the solid material being at the entrance to or within the converging inlet portion of the nozzle bore, to prevent build-up of particle material on the nozzle bore wall while insuring sufficient particle dwell time within the gas stream to effect particle heat softening or melting prior to particle impact on a substrate downstream of the discharge end of said nozzle bore.

6. A highly concentrated, hot gas supersonic abrasive blast apparatus comprising:

an abrasive blast gun body, a high pressure, essentially closed combustion chamber within said body, means for continuously flowing an oxy-fuel mixture under high pressure through said combustion chamber for ignition within said chamber, said body including combustion chamber products of combustion discharge passage means at one end thereof, said body further comprising an elongated nozzle downstream of said combustion chamber discharge passage means, said nozzle including a converging inlet bore portion leading to a throat and having an extended length outlet portion leading from said throat, and wherein said bore has a length that is at least five times the diameter of said nozzle bore throat, said combustion chamber discharge passage means comprising means for conveying a converging flow of the discharged hot products of combustion, after exit from the combustion chamber, into the entrance of the nozzle inlet bore portion, and means for introducing solid, particulate, abrasive material outside of said combustion chamber, axially into the hot combustion gases for acceleration thereby with the point of introduction of the particulate abrasive material being at the entrance to or within the converging inlet portion of the bore of said nozzle to restrict the diameter of the column of particles passing through the nozzle bore and prevent contact of the particles with the nozzle bore wall and erosion of the nozzle bore while accelerating the particles to very high velocity prior to particle impact on a workpiece downstream from the discharge end of the nozzle bore.

7. The apparatus as claimed in claim 6, wherein the axis of said nozzle bore and the axis of said combustion chamber are at approximately right angles to each other, said combustion chamber comprises an end wall, said combustion chamber discharge passage means comprise a plurality of circumferentially spaced converging, inclined, small diameter passages within said combustion chamber end wall, said inclined passages being open at one end to the inlet portion of the nozzle bore upstream of the nozzle bore throat and at the other end to said combustion chamber, and wherein said means for introducing solid particulate abrasive material into the hot gases comprises a small diameter particulate material feed passage within said body centered within said circumferentially spaced, inclined passages which converge towards the axis of the bore and with said material feed passage being coaxial with said nozzle bore.

8. The apparatus as claimed in claim 6, wherein said means for introducing solid, particulate, abrasive material axially into the hot combustion gases comprises means for supplying a stream of combustible fluid bearing hard particulate material to said apparatus upstream of said combustion chamber discharge passage means within said body including means defining a confined straight flow path leading to said small diameter material feed passage within said body and centered within said circumferentially spaced, inclined small diameter passages, and means within said confined straight flow path for separating a portion of the combustible fluid radially outward of said confined straight flow path from said hard particulate material and for introducing said particle free fluid into said essentially closed combustion chamber within said body for combustion therein.

9. The apparatus as claimed in claim 7, wherein said means for introducing solid, particulate, abrasive material axially into the hot combustion gases comprises means for supplying a stream of combustible fluid bearing hard particulate material to said apparatus upstream of said combustion chamber discharge passage means within said body including means defining a confined straight flow path leading to said small diameter material feed passage within said body and centered within said circumferentially spaced, inclined, small diameter passages, and means within said confined straight flow path for separating a portion of the combustible fluid radially outward of said confined straight flow path from said hard particulate material and for introducing said particle free fluid into said essentially closed combustion chamber within said body for stabilization of combustion therein.

10. The apparatus as claimed in claim 8, wherein said means for separating combustible fluid free of said hard particulate material from said stream comprises a tubular sand separator positioned within said body axial flow passage, an annular chamber surrounding said tubular sand separator, said tubular sand separator bearing spaced slots, said slots having openings less than the diameter of said solid particulate abrasive material, and wherein said annular chamber surrounding said tubular sand separator is connected by passage means with said combustion chamber to permit the introduction of particle free air from said stream into said combustion chamber.

11. The apparatus as claimed in claim 9, wherein said means for separating combustible fluid free of said hard particulate material from said stream comprises a tubular sand separator positioned within said body axial flow passage, an annular chamber surrounding said cylindrical sand separator, said tubular sand separator bearing spaced slots, said slots having openings less than the diameter of said solid particulate abrasive material, and wherein said annular chamber surrounding said tubular sand separator is connected by passage means with said combustion chamber to permit the introduction of particle free air from said stream into said combustion chamber.

* * * * *